US009472905B2

(12) United States Patent
Peng et al.

(10) Patent No.: US 9,472,905 B2
(45) Date of Patent: Oct. 18, 2016

(54) ELECTRIC CONNECTOR AND CABLE CONNECTOR ASSEMBLY

(71) Applicant: Shenzhen Deren Electronic Co., Ltd, Shenzhen (CN)

(72) Inventors: Junlan Peng, Shenzhen (CN); Zhengyi Chen, Shenzhen (CN); ZhuDong Huo, Shenzhen (CN)

(73) Assignee: SHENZHEN DEREN ELECTRONIC CO., LTD, Shenzhen (CN)

( * ) Notice: Subject to any disclaimer, the term of this patent is extended or adjusted under 35 U.S.C. 154(b) by 0 days.

(21) Appl. No.: 14/426,926

(22) PCT Filed: Jan. 27, 2015

(86) PCT No.: PCT/CN2015/071595
§ 371 (c)(1),
(2) Date: Mar. 9, 2015

(65) Prior Publication Data

US 2016/0218467 A1 Jul. 28, 2016

(30) Foreign Application Priority Data

Dec. 30, 2014 (CN) ..... 2014 2 0856932

(51) Int. Cl.
*H01R 9/03* (2006.01)
*H01R 13/66* (2006.01)
*H01R 12/51* (2011.01)

(52) U.S. Cl.
CPC ..... *H01R 13/665* (2013.01); *H01R 12/51* (2013.01)

(58) Field of Classification Search
CPC .. H01R 13/65802; H01R 4/64; H01R 4/646; H01R 23/688; H01R 12/79; H01R 23/662; H01R 13/658; H01R 23/7073
USPC ..... 439/95–98, 108, 493, 497, 607.01, 439/607.41, 607.5, 660
See application file for complete search history.

(56) References Cited

U.S. PATENT DOCUMENTS 6,129,594 A * 10/2000 Lai ..... H01R 13/506 439/596
6,336,827 B1 * 1/2002 Akama ..... H01R 12/62 174/261

(Continued)

FOREIGN PATENT DOCUMENTS

CN 2427901 Y 4/2001
CN 201498675 U 6/2010

(Continued)

OTHER PUBLICATIONS

International Search Report (ISR) dated Aug. 17, 2015 for International Application No. PCT/CN2015/071595 with English translation.

(Continued)

*Primary Examiner* — Thanh Tam Le
(74) *Attorney, Agent, or Firm* — Ladas & Parry LLP

(57) ABSTRACT

The present invention discloses an electric connector and a cable connector assembly. The electric connector comprises: an insulative housing, a front end of the insulative housing being provided with a first terminal groove and a second terminal groove, a top portion and a bottom portion at a rear end of the insulative housing being respectively provided with a first barrier and a second barrier, a first receiving groove being formed between the first barrier and the second barrier; and a printed circuit board received in a clamping space. According to the present invention, the printed circuit board may be clamped on a rear end of the insulative housing.

11 Claims, 7 Drawing Sheets

(56) References Cited

U.S. PATENT DOCUMENTS 7,462,071 B1 * 12/2008 Wu ..... H01R 9/032 439/497
7,632,155 B1 * 12/2009 Wu ..... H01R 9/035 439/497
7,651,379 B1 * 1/2010 Wu ..... H01R 12/62 439/108
7,758,374 B2 * 7/2010 Yu ..... H01R 4/027 439/493
7,785,140 B2 * 8/2010 Henry ..... H01R 13/514 439/541.5
7,828,597 B1 * 11/2010 Jin ..... H01R 13/65807 439/607.05
8,011,960 B2 * 9/2011 Xiao ..... H01R 27/02 439/607.24
8,328,579 B2 * 12/2012 Sasaki ..... H01R 13/659 439/607.25
8,956,167 B2 * 2/2015 Wu ..... H01R 13/40 439/497

FOREIGN PATENT DOCUMENTS

CN 202840014 U 3/2013
EP 2 808 954 A1 12/2014

OTHER PUBLICATIONS

Written Opinion (WO) dated Aug. 7, 2015 for International Application No. PCT/CN2015/071595.
espacenet English abstract of CN 201498675 U.
espacenet English abstract of CN 202840014 U.
espacenet English abstract of CN 2427901 Y.

* cited by examiner

ELECTRIC CONNECTOR AND CABLE CONNECTOR ASSEMBLY

RELATED APPLICATION

This application is a national phase entry under 35 USC 371 of International Patent Application PCT/CN2015/071595, filed Jan. 27, 2015, which claims priority to Chinese Patent Application No. 200420856932.1, filed Dec. 30, 2014, both of which are hereby incorporated by reference in their entireties.

TECHNICAL FIELD

The present invention relates to an electric connector and a cable connector assembly.

BACKGROUND

Electric connectors are also referred to as circuit connectors. The electric connector is a conductive device that bridges two conductors in a loop, such that currents or signals may flow from one conductor to another conductor. The electric connectors are widely applied in various electrical lines, achieving the function of connecting or disconnecting the currents or signals.

In the related art, the electric connector comprises: a conductive terminal socket, a printed circuit board connected to the conductive terminal socket, and a housing. The conductive terminal socket is secured at a front end of the housing, and the printed circuit board is positioned inside the housing. Since the printed circuit board is not secured to the housing, during transportation of the connector, the printed circuit board may collide with the housing, and thus may damage the printed circuit board and affect the performance of the electric connector.

SUMMARY

The problem to be solved in the present invention is to provide an electric connector and a cable connector assembly, which are capable of clamping a printed circuit board at a rear end of an insulative housing.

To solve the problem, the present invention employs the following technical solution:

An electric connector is provided, comprising:

an insulative housing, the insulative housing comprising a base, a front end portion and a rear end portion that extend from two ends of the base, a front end of the insulative housing being provided with first terminal grooves and second terminal grooves, a top portion at a rear end of the insulative housing being provided with a first barrier, a bottom portion at the rear end of the insulative housing being provided with a second barrier, first receiving grooves being formed between two neighboring first barriers, second receiving grooves being formed between two neighboring second barriers, a clamping space being formed between the first barrier and the second barrier;

first conductive terminals, each of the first conductive terminals comprising a first contact portion, a first connection portion having one end connected to the first contact portion, and a first extension portion extending from the other end of the first connection portion, the first contact portion and the first connection portion being both positioned in each of the first terminal grooves, the first extension portion being inserted into each of the first receiving grooves; and second conductive terminals, each of the second conductive terminals comprising a second contact portion, a second connection portion having one end connected to the second contact portion, and a second extension portion extending from the other end of the second connection portion, the second contact portion and the second connection portion being both positioned in each of the second terminal grooves, the second extension portion being inserted into each of the second receiving grooves;

wherein a first soldering portion is formed by extension at the first extension portion along a direction facing towards each of the second conductive terminals, and a second soldering portion is formed by extension at the second extension portion along a direction facing towards each of the first conductive terminals.

The electric connector further comprises a printed circuit board received in the clamping space, the printed circuit board being provided with a first soldering region; and the first soldering portion and the second soldering portion are soldered in the first soldering region of the printed circuit board.

The first barrier is provided with a first bump, the second barrier is provided with a second bump, and the first soldering region is received at the rear end of the insulative housing and abuts against the first bump and the second bump.

A first receiving space is formed between the first bump and the second bump.

The electric connector further comprises a grounding tab.

The grounding tab is positioned between the first conductive terminals and the second conductive terminals, a rear end portion of the grounding tab is received in the receiving space, the grounding tab is provided with a grounding pin, and the printed circuit board is provided with a second soldering region, the grounding pin being soldered in the second soldering region.

The first connection portion is upwardly provided with a first detention point and a second detention point, wherein the first detention point is received in each of the first terminal grooves, and the second detention point abuts against an end face of the base.

The second connection portion is downwardly provided with a third detention point and a fourth detention point, wherein the third detention point is received in each of the second terminal grooves, and the fourth detention point abuts against the end face of the base.

The electric connector further comprises an upper metal tab positioned on an upper surface of the insulative housing and a lower metal tab positioned on a lower surface of the insulative housing.

To solve the above technical problem, the present invention employs the following technical solution:

A cable connector assembly is provided, comprising:

an insulative housing, a front end of the insulative housing being provided with first terminal grooves and second terminal grooves, a top portion at a rear end of the insulative housing being provided with a first barrier, a bottom portion at the rear end of the insulative housing being provided with a second barrier, first receiving grooves being formed between two neighboring first barriers, second receiving grooves being formed between two neighboring second barriers, a clamping space being formed between the first barrier and the second barrier;

first conductive terminals, each of the first conductive terminals comprising a first contact portion, a first connection portion having one end connected to the first contact portion, and a first extension portion extending from the other end of the first connection portion, the first contact portion and the first connection portion being both positioned in each of the first terminal grooves, the first extension portion being inserted into each of the first receiving grooves; and second conductive terminals, each of the second conductive terminals comprising a second contact portion, a second connection portion having one end connected to the second contact portion, and a second extension portion extending from the other end of the second connection portion, the second contact portion and the second connection portion being both positioned in each of the second terminal grooves, the second extension portion being inserted into each of the second receiving grooves;

wherein a first soldering portion is formed by extension at the first extension portion along a direction facing towards each of the second conductive terminals, and a second soldering portion is formed by extension at the second extension portion along a direction facing towards each of the first conductive terminals; and a printed circuit board received in the clamping space, the first soldering portion and the second soldering portion being soldered on the printed circuit board.

The cable connector assembly further comprises:

an upper housing; and a lower housing, on which the upper housing is jointed, a second receiving space for receiving the printed circuit board being formed between the upper housing and the lower housing, each side wall of the lower housing being partially outwardly bent to form a receiving groove on the side wall of the lower housing, each side of the printed circuit board being received in the receiving groove, the insulative housing being secured at a front end of the upper housing and the lower housing.

Each side wall of the upper housing is inwardly bent to form a holding portion, the holding portion abutting against an upper surface of the printed circuit board.

Each side wall of the upper housing is provided with an opening, the opening mating with the partially outwardly bending portion of the side wall of the lower housing, such that a lower end of the opening on the side wall of the upper housing abuts against an upper end of the bending portion.

The cable connector assembly further comprises a grounding tab, the grounding tab being positioned between the first conductive terminals and the second conductive terminals, the grounding tab being provided with a grounding pin, the grounding pin being soldered on the printed circuit board.

The insulative housing comprises a base, a front end portion and a rear end portion that extend from two ends of the base.

The first connection portion is upwardly provided with a first detention point and a second detention point, wherein the first detention point is received in each of the first terminal grooves, and the second detention point abuts against an end face of the base.

The second connection portion is downwardly provided with a third detention point and a fourth detention point, wherein the third detention point is received in each of the second terminal grooves, and the fourth detention point abuts against the end face of the base.

The electric connector further comprises an upper metal tab positioned on an upper surface of the insulative housing and a lower metal tab positioned on a lower surface of the insulative housing.

The present invention achieves the following beneficial effects:

Different from the related art, in the embodiments of the present invention, the rear end of the insulative housing is provided with a first barrier and a second barrier, wherein a clamping space is formed between the first barrier and the second barrier, the printed circuit board is received in the clamping space, such that the printed circuit board is clamped on the insulative housing.

DETAILED DESCRIPTION

For better understanding of the present invention, the present invention is described in detail with reference to attached drawings and specific embodiments. It should be noted that, when an element is defined as "being secured or fixed to" another element, the element may be directly positioned on the element or one or more centered elements may be present therebetween. When an element is defined as "being connected or coupled to" another element, the element may be directly connected or coupled to the element or one or more centered elements may be present therebetween. As used herein, the terms "vertical", "horizontal", "left", "right", and similar expressions are for illustration purposes.

Unless the context clearly requires otherwise, throughout the specification and the claims, technical and scientific terms used herein denote the meaning as commonly understood by a person skilled in the art. Additionally, the terms used in the specification of the present invention are merely for description the embodiments of the present invention, but are not intended to limit the present invention. As used herein, the term "and/or" in reference to a list of two or more items covers all of the following interpretations of the term:

any of the items in the list, all of the items in the list and any combination of the items in the list.

The present invention is further described with reference to the accompanying drawings and exemplary embodiments.

Figure 1:
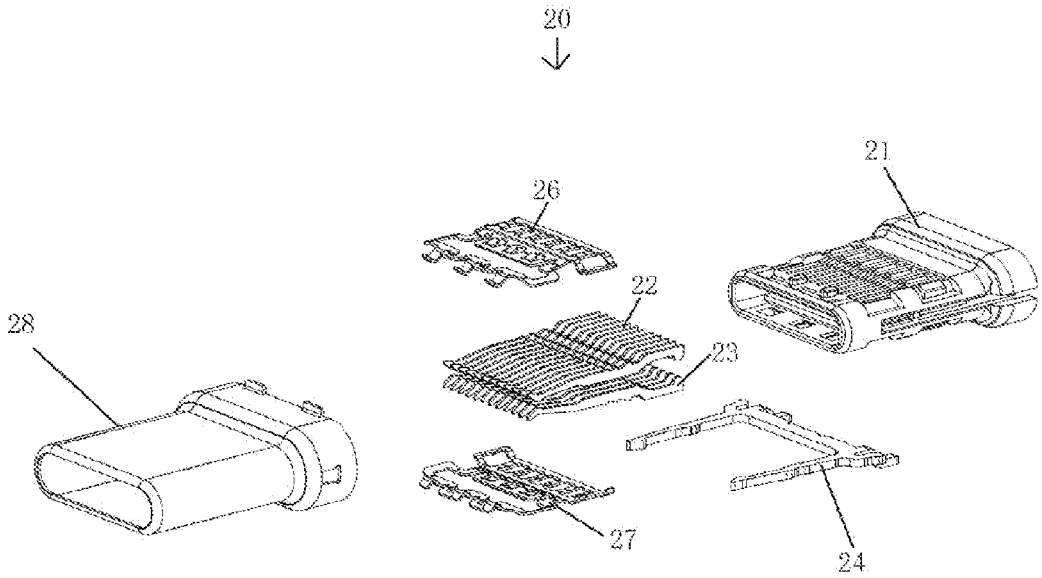
FIG. 1 is a schematic exploded structural view of an electric connector according to an embodiment of the present invention.
Figure 2:
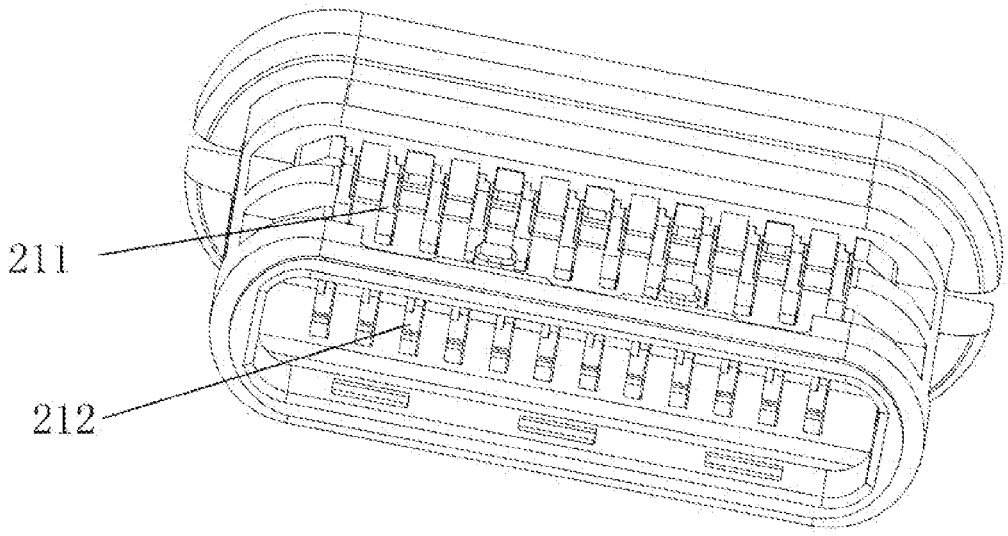
FIG. 2 is a schematic view of first terminal grooves and a second terminal grooves of the electric connector according to an embodiment of the present invention.
Figure 3:
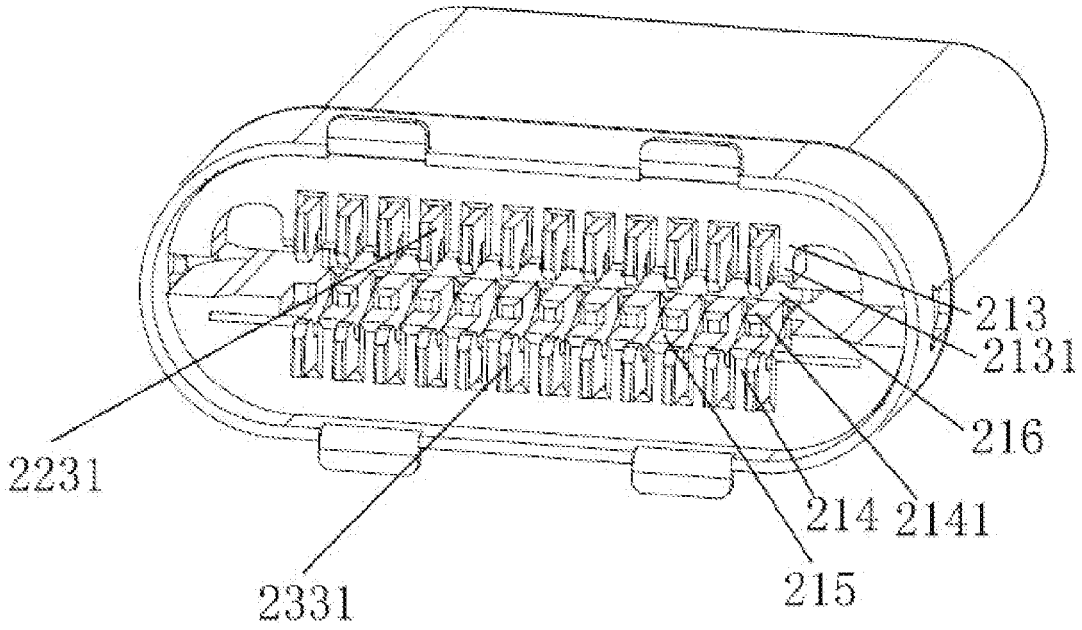
FIG. 3 is a schematic view of a rear end of the electric connector according to an embodiment of the present invention.

Referring to FIG. 1, FIG. 2, and FIG. 3, an electric connector 20 comprises an insulative housing 21, first conductive terminals 22, and second conductive terminals 23.

A front end of the insulative housing 21 is provided with first terminal grooves 211 and second terminal grooves 212, a top portion at a rear end of the insulative housing 21 is provided with a first barrier 213, a bottom portion at the rear end of the insulative housing 21 is provided with a second barrier 214, wherein a plurality of first barriers 213 and second barriers 214 may be used, first receiving grooves (not illustrated in the drawings) are formed between two neighboring first barriers 213, each of the first terminal grooves 211 is communicated with each of the first receiving grooves, second receiving grooves are formed between two neighboring second barriers 214, each of the second terminal grooves 212 is communicated with each of the second receiving grooves, and a clamping space 215 is formed between the first barrier 213 and the second barrier 214.

Figure 4:
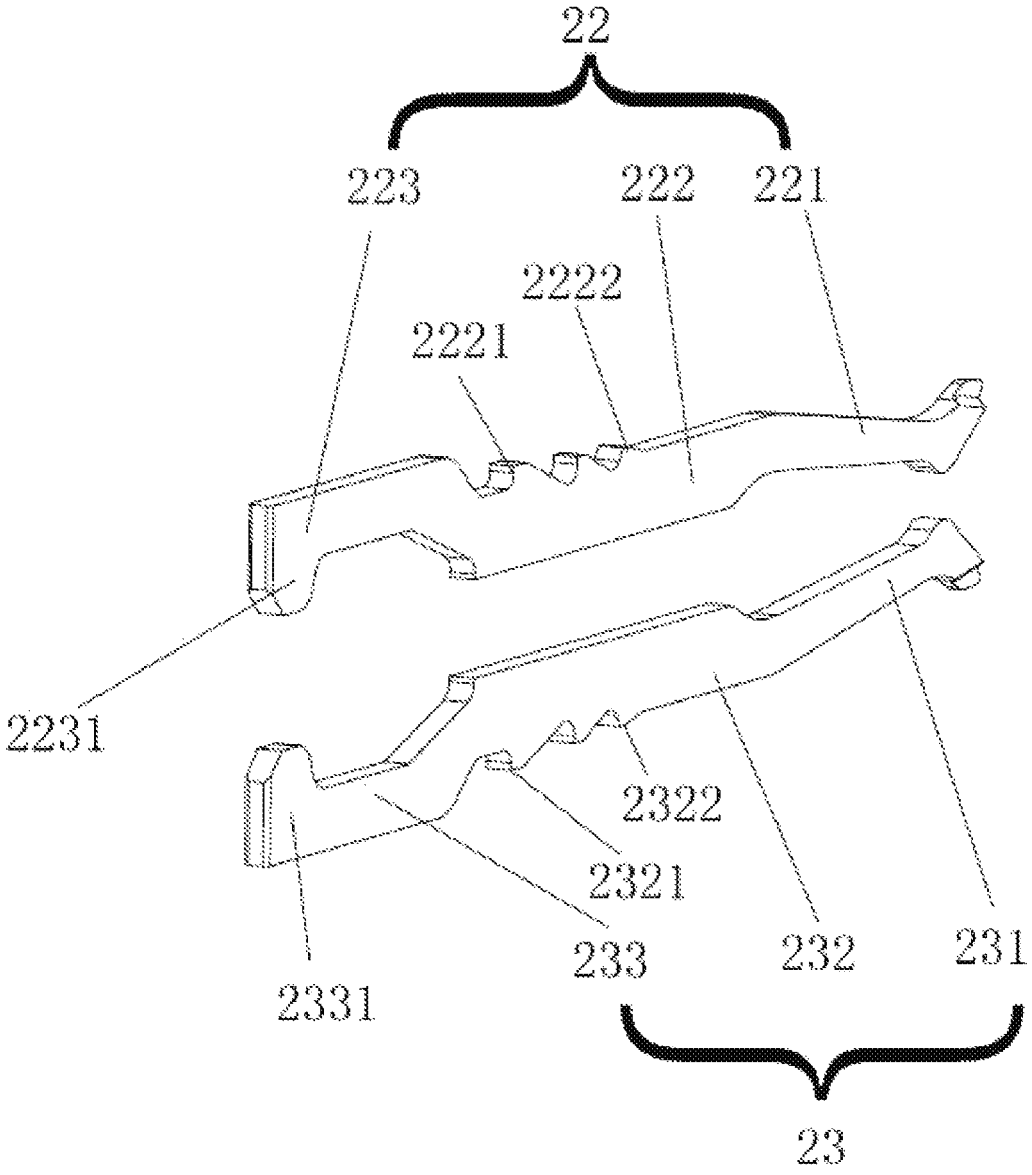
FIG. 4 is a schematic view of first conductive terminals and a second conductive terminals of the electric connector according to an embodiment of the present invention.

Referring to FIG. 4, each of the first conductive terminals 22 comprises a first contact portion 221, a first connection portion 222 having one end connected to the first contact portion 221, and a first extension portion 223 extending from the other end of the first connection portion 222, wherein the first contact portion 221 and the first connection portion 222 are both positioned in each of the first terminal grooves 211, and the first extension portion 223 is inserted into each of the first receiving grooves. Specifically, the first contact portion 221 is positioned at a top portion of each of the first terminal grooves 211, the first extension portion 223 is positioned at a bottom portion of each of the first terminal grooves 211, and the first extension portion 223 is inserted into each of the first receiving grooves. Each of the second conductive terminals 23 comprises a second contact portion 231, a second connection portion 232 having one end connected to the second contact portion 231, and a second extension portion 2231 extending from the other end of the second connection portion 232, wherein the second contact portion 231 and the second connection portion 232 are both positioned in each of the second terminal grooves 212, and the second extension portion 233 is inserted into each of the second receiving grooves. Specifically, the second contact portion 231 is positioned at a top portion of each of the second terminal grooves 212, the second extension portion 233 is positioned at a bottom portion of each of the second terminal grooves 212, and the second extension portion 233 is inserted into each of the second receiving grooves. A first soldering portion 2231 is formed by extension at the first extension portion 223 along a direction facing towards each of the second conductive terminals 23, and a second soldering portion 2331 is formed by extension at the second extension portion 233 along a direction facing towards each of the first conductive terminals 22.

Figure 5:
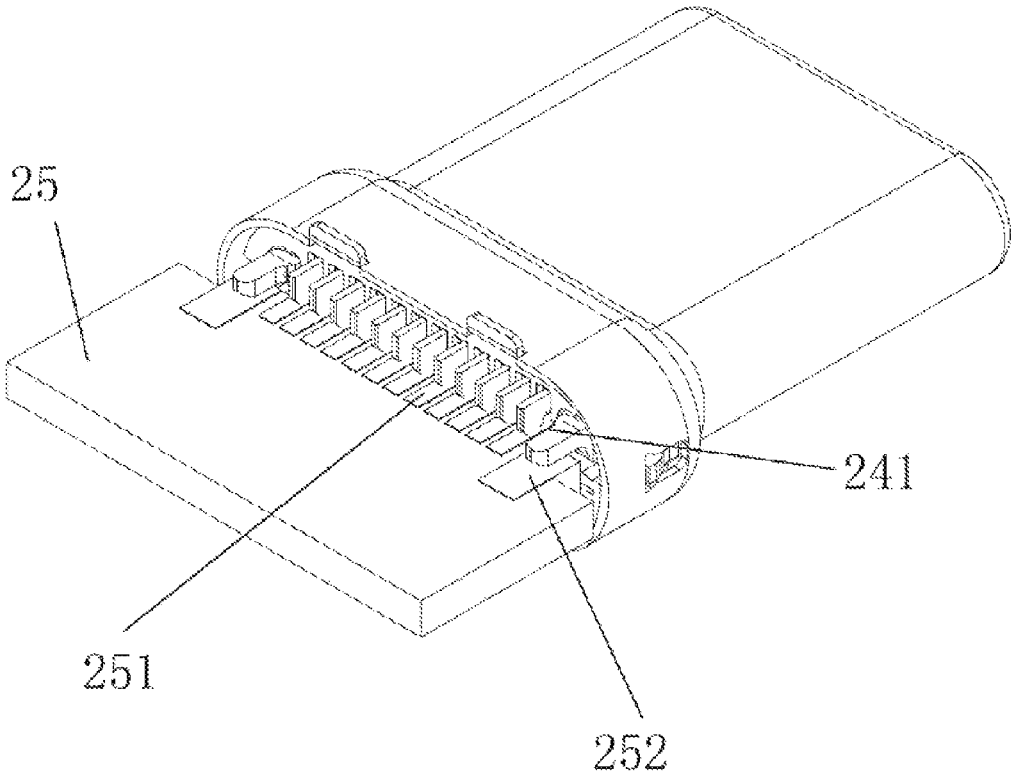
FIG. 5 is a schematic view illustrating a printed circuit board on an insulative housing of the electric connector according to an embodiment of the present invention.

With reference to FIG. 5, the electric connector 20 further comprises a grounding tab 24 and a printed circuit board 25 received in the clamping space 215. The first barrier 213 is provided with a first bump 2131, and the second barrier 214 is provided with a second bump 2141, wherein a first receiving space 216 is formed between the first bump 2131 and the second bump 2141. The printed circuit board 25 comprises a first soldering region 251 and a second soldering region 252 forming a step structure with the first soldering region 251, wherein the first soldering region is received at the rear end of the insulative housing and abuts against the first bump 2131 and the second bump 2141. The grounding tab 24 is positioned between the first conductive terminals 22 and the second conductive terminals 23, and a rear end portion of the grounding tab 24 is partially received in the receiving space 216, wherein the grounding tab 24 is provided with a grounding pin 241. The first soldering portion 2231 and the second soldering portion 2331 are soldered in the first soldering region 251, and the grounding pin 241 is soldered on the second soldering region 252. In this embodiment, preferably, the thickness of a front end of the first contact portion 221 of each of the first conductive terminals 22 is less than the thickness of the other portions of each of the first conductive terminals 22, the thickness of a front end of the second contact portion 231 of each of the second conductive terminals 23 is less than the thickness of other portions of each of the second conductive terminals 23.

Figure 6:
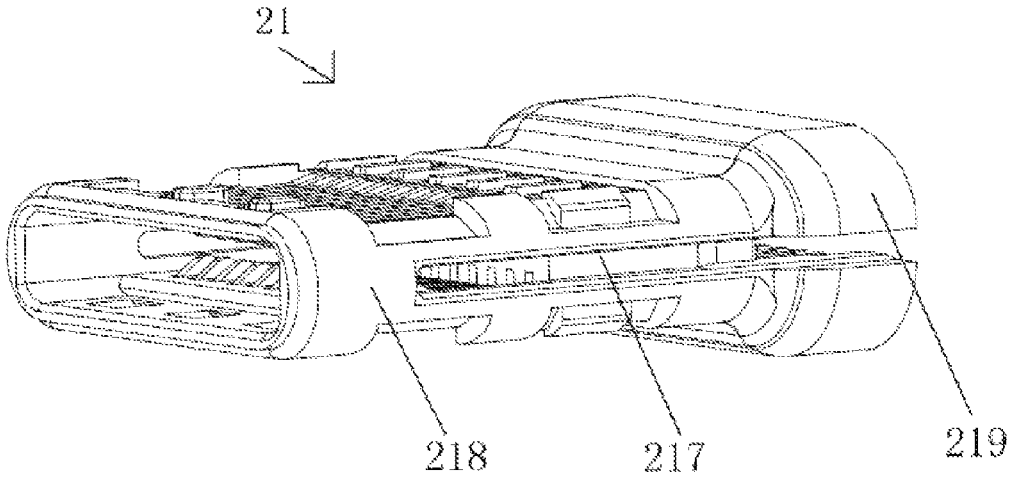
FIG. 6 is a schematic side view of the electric connector according to an embodiment of the present invention.
Figure 7:
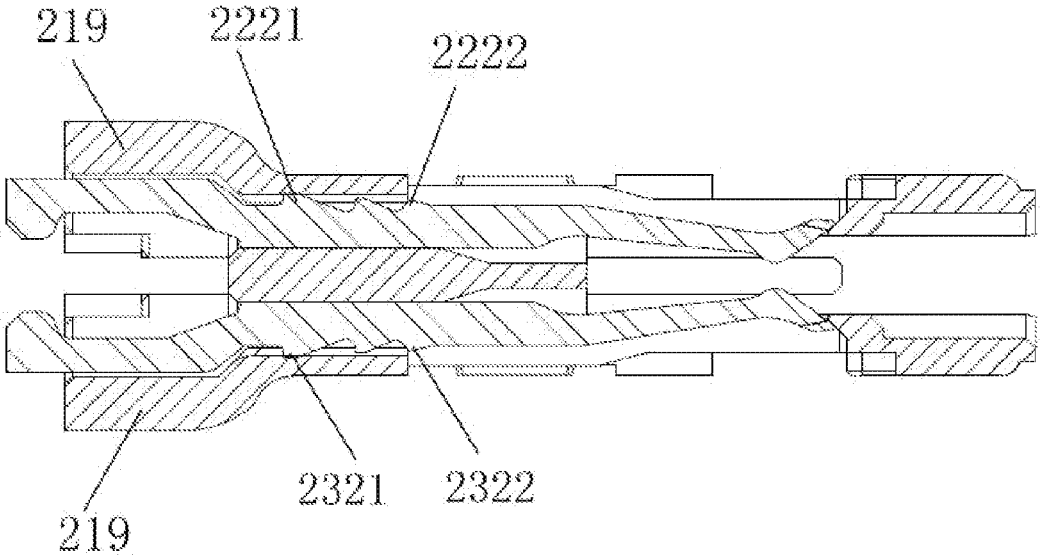
FIG. 7 is a schematic sectional view of the electric connector according to an embodiment of the present invention.
Figure 8:
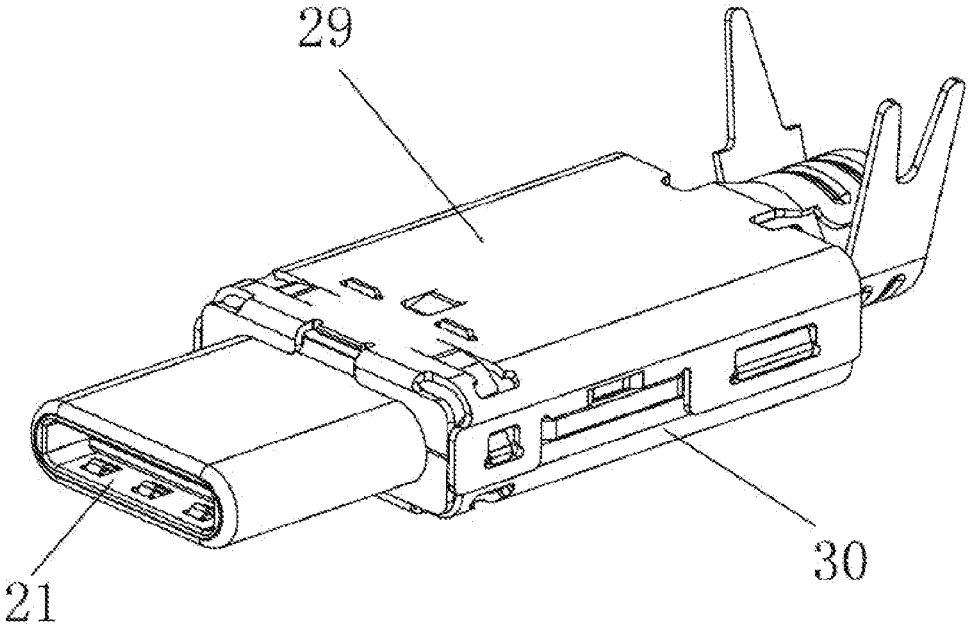
FIG. 8 is a schematic three-dimensional view of a cable connector assembly according to an embodiment of the present invention.
Figure 9:
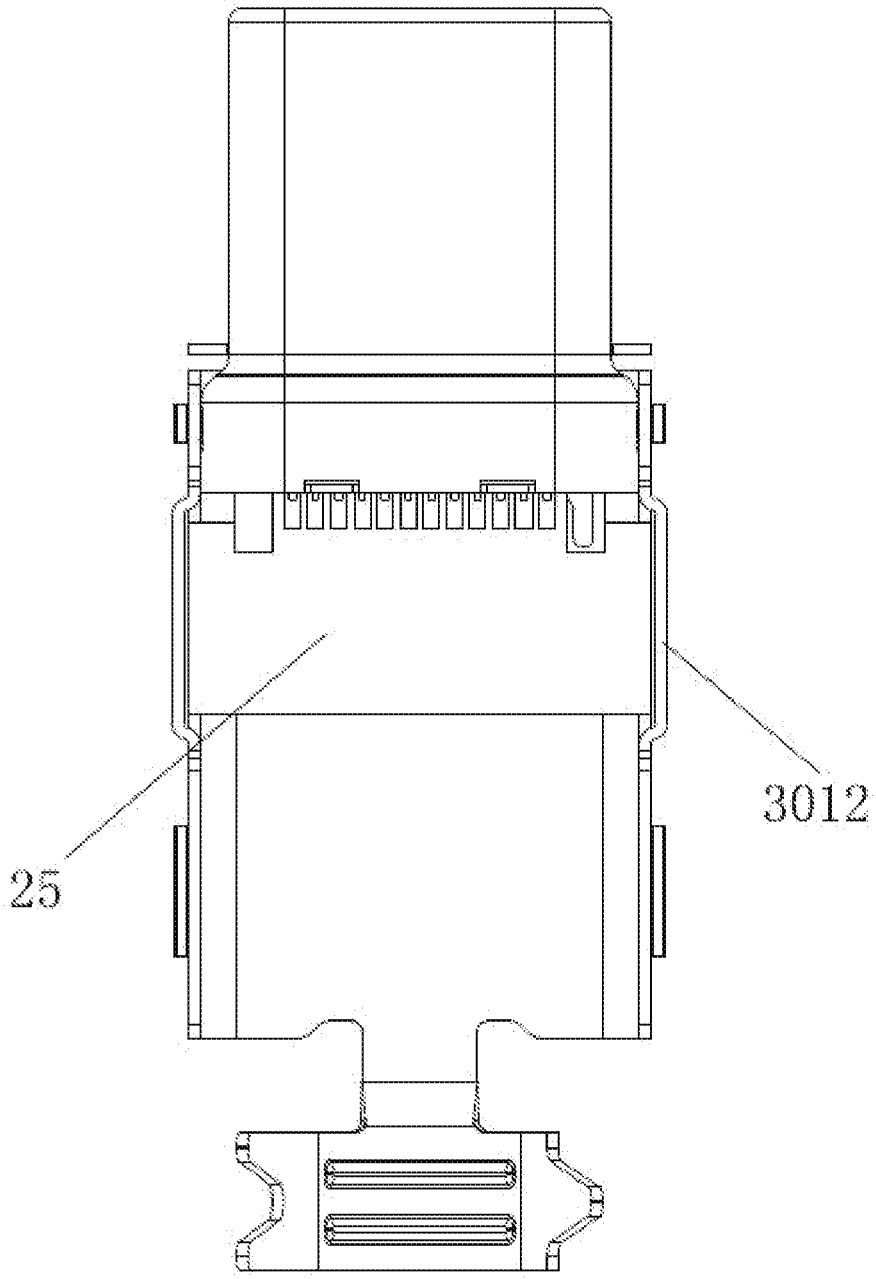
FIG. 9 is a schematic sectional view of the cable connector assembly according to an embodiment of the present invention.
Figure 10:
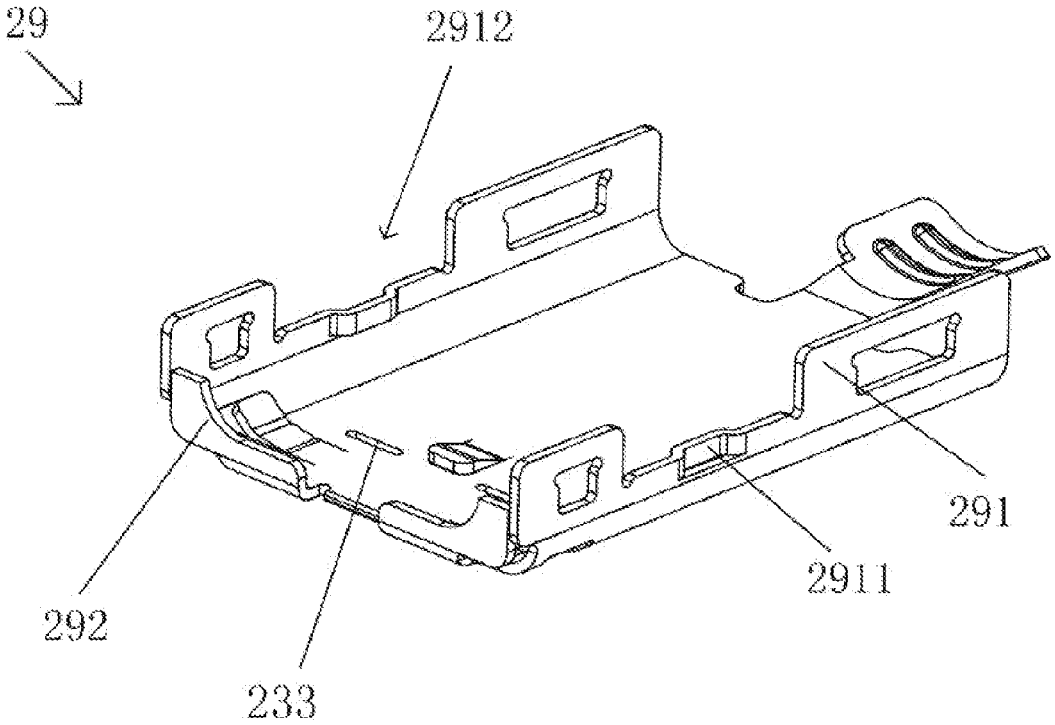
FIG. 10 is a schematic view of an upper housing of the cable connector assembly according to an embodiment of the present invention.
Figure 11:
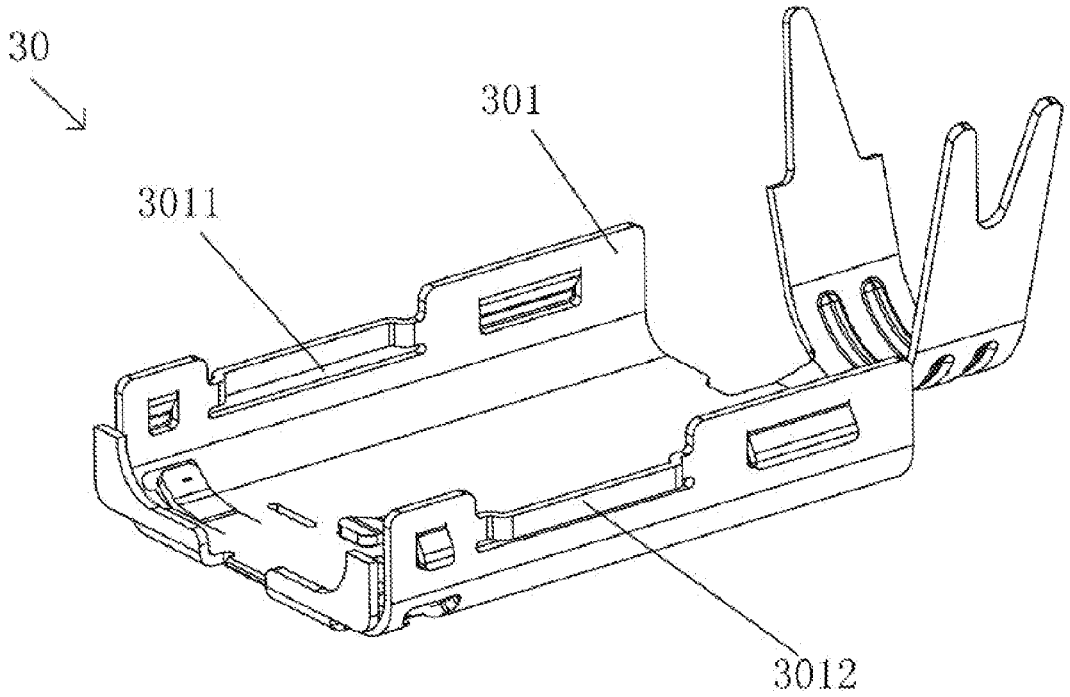
FIG. 11 is a schematic view of a lower housing of the cable connector assembly according to an embodiment of the present invention.

Referring to FIG. 4, FIG. 6, and FIG. 7, the insulative housing 21 comprises a base 217, and a front end portion 218 and a rear end portion 219 that extend from two ends of the base 217. The first connection portion 222 is upwardly provided with a first detention point 2221 and a second detention point 2222, wherein the first detention point 2221 is received in each of the first terminal grooves 211, and the second detention point 2222 abuts against an end face of the base 217. The second connection portion 232 is downwardly provided with a third detention point 2321 and a fourth detention point 2322, wherein the third detention point 2321 is received in each of the second terminal grooves 212, and the fourth detention point 2322 abuts against the end face of the base 217.

Further, referring to FIG. 1 again, the electric connector 20 further comprises an upper metal tab 26 positioned on an upper surface of the insulative housing 21 and a lower metal tab 27 and a metal housing 28 that are positioned on a lower surface of the insulative housing 21. The metal housing 28 wraps the insulative housing 21, and the upper metal tab 26 and the lower metal tab 27 are positioned between the metal housing 28 and the insulative housing 21.

In the embodiments of the present invention, the rear end of the insulative housing is provided with a first barrier and a second barrier, wherein a clamping space is formed between the first barrier and the second barrier, the printed circuit board is received in the clamping space, such that the printed circuit board is clamped on the insulative housing.

The present invention further provides an embodiment illustrating a cable connector assembly. Still referring to FIG. 1, FIG. 2, FIG. 3, FIG. 4, and FIG. 5, and with reference to FIG. 8, FIG. 9, FIG. 10, and FIG. 11, the cable connector assembly comprises an insulative housing 21, first conductive terminals 22, second conductive terminals 23, a printed circuit board 25, an upper housing 29, and a lower housing 30.

A front end of the insulative housing 21 are provided with first terminal grooves 211 and second terminal grooves 212, a top portion at a rear end of the insulative housing 21 is provided with a first barrier 213, a bottom portion at the rear end of the insulative housing 21 is provided with a second barrier 214, wherein a plurality of first barriers 213 and second barriers 214 may be used, first receiving grooves (not illustrated in the drawings) are formed between two neighboring first barriers 213, each of the first terminal grooves 211 is communicated with each of the first receiving groove, second receiving groove are formed between two neighboring second barriers 214, each of the second terminal grooves 212 is communicated with each of the second receiving grooves, and a clamping space 215 is formed between the first barrier 213 and the second barrier 214.

Each of the first conductive terminals 22 comprises a first contact portion 221, a first connection portion 222 having one end connected to the first contact portion 221, and a first extension portion 223 extending from the other end of the first connection portion 222, wherein the first contact portion 221 and the first connection portion 222 are both positioned in each of the first terminal grooves 211. Specifically, the first contact portion 221 is positioned at a top portion of each of the first terminal grooves 211, the first extension portion 223 is positioned at a bottom portion of each of the first terminal grooves 211, and the first extension portion 223 is inserted into each of the first receiving grooves. Each of the second conductive terminals 23 comprises a second contact portion 231, a second connection portion 232 having one end connected to the second contact portion 231, and a second extension portion 2231 extending from the other end of the second connection portion 232, wherein the second contact portion 231 and the second connection portion 232 are both positioned in each of the second terminal grooves 212. Specifically, the second contact portion 231 is positioned at a top portion of each of the second terminal, the second connection portion 233 is positioned at a bottom portion of each of the second terminal groove 212, and the second extension portion 233 is inserted into each of the second receiving grooves. A first soldering portion 2231 is formed by extension portion 223 along a direction facing towards each of the second conductive terminals 23, and a second soldering portion 2331 is formed by extension at the second extension portion 233 along a direction facing towards each of the first conductive terminals 22. The printed circuit board 25 is received in the clamping space 214, and the first soldering portion 2231 and the second soldering portion 2331 are soldered on the printed circuit board.

The upper housing 29 is jointed on the lower housing 30, and a second receiving space (not illustrated in the drawings) for receiving the printed circuit board is formed between the upper housing 29 and the lower housing 30. The insulative housing 21 is secured on a front end of the upper housing 29 and the lower housing 30. Each side wall 301 of the lower housing 30 is partially outwardly bent to form a receiving groove 3011 on the side wall 301 of the lower housing 30, and each side of the printed circuit board 25 is received in the receiving groove 3011, such that the printed circuit board 25 is secured in the two side directions.

Further, each side wall 291 of the upper housing 29 is inwardly bent to form a holding portion 2911, and when the upper housing 29 is jointed on the lower housing 30, the holding portion 2911 abuts against an upper surface of the printed circuit board 25, such that the upper housing 29 and the lower housing 30 clamp and secure the printed circuit board 25 in up and down directions. In this way, the printed circuit board 25 is more stably and reliably secured.

Each side wall 301 of the lower housing 30 is partially outwardly bent to form a bending portion 3012, and the side wall 291 of the upper housing 29 is provided with an opening 2912, wherein the opening 2912 mates with the outwardly bending portion 3012 of the side wall of the lower housing 30, such that a lower end of the opening 2912 on the side wall 291 of the upper housing 29 abuts against an upper end of the bending portion 3012. In this way, the assembled cable connector assembly is not subjected to depressions, and is more beautiful.

The electric connector 20 further comprises a grounding tab 24, a printed circuit board 25 received in the clamping space 215, and a cable (not illustrated in the drawings). The first barrier 213 is provided with a first bump 2131, the second barrier 214 is provided with a second bump 2141, and a receiving space 216 is formed between the first bump 2131 and the second bump 2141. The printed circuit board 25 comprises a first soldering region 251 and a second soldering region 252 forming a step structure with the first soldering region 251, wherein the first soldering region is received at a rear end of the insulative housing and abuts against the first bump 2131 and the second bump 2141. The grounding tab 24 is positioned between the first conductive terminals 22 and the second conductive terminals 23, and a rear end portion of the grounding tab 24 is received in the receiving space 216, wherein the grounding tab 24 is provided with a grounding pin 241. The first soldering portion 2231 and the second soldering portion 2331 are soldered in the first soldering region 251, and the grounding pin 241 is soldered in the second soldering region 252. The cable is soldered on the printed circuit board 25. In this embodiment, the cable is a circular cable or flexible flat cable.

In the embodiments of the present invention, the rear end of the insulative housing is provided with a first barrier and a second barrier, wherein a clamping space is formed between the first barrier and the second barrier, the printed circuit board is received in the clamping space, such that the printed circuit board is clamped on the insulative housing.

It should be noted that the specification and drawings of the present invention illustrate preferred embodiments of the present invention. However, the present invention may be implemented in different manners, and is not limited to the embodiments described in the specification. The embodiments described are not intended to limit the present invention, but are directed to rendering a thorough and comprehensive understanding of the disclosure of the present invention. In addition, the above described technical feature may incorporate and combine with each other to derive various embodiments not illustrated in the above specification, and such derived embodiments shall all be deemed as falling within the scope of the disclosure contained in the specification of the present invention. Further, a person skilled in the art may make improvements or variations according to the above description, and such improvements or variations shall all fall within the protection scope as defined by the claims of the present invention.

What is claimed is:

1. An electric connector, comprising:

an insulative housing, comprising a base, a front end portion and a rear end portion that extend from two ends of the base, the rear end portion being via extension from the base towards an upper rear part and a lower rear part, the front end of the insulative housing being provided with first terminal grooves and second terminal grooves, a top portion at the rear end of the insulative housing being provided with a first barrier, a bottom portion at the rear end of the insulative housing being provided with a second barrier, first receiving grooves being formed between two neighboring first barriers, second receiving grooves being formed between two neighboring second barriers, a clamping space being formed between the first barrier and the second barrier;

first conductive terminals, each of the first conductive terminals comprising a first contact portion, a first connection portion having one end connected to the first contact portion, and a first extension portion extending from the other end of the first connection portion towards a direction distal from the second conductive terminals, the first contact portion and the first connection portion being both positioned in each of the first terminal grooves, the first extension portion being inserted into each of the first receiving grooves; and second conductive terminals, each of the second conductive terminals comprising a second contact portion, a second connection portion having one end connected to the second contact portion, and a second extension portion extending from the other end of the second connection portion towards a direction distal from the first conductive terminals, the second contact portion and the second connection portion being both positioned in each of the second terminal grooves, the second extension portion being inserted into each of the second receiving grooves;

an upper metal tab positioned on an upper surface of the insulative housing; and a lower metal tab and a metal housing positioned on a lower surface of the insulative housing;

wherein a first soldering portion is formed by extension at the first extension portion along a direction facing towards each of the second conductive terminals, and a second soldering portion is formed by extension at the second extension portion along a direction facing towards each of the first conductive terminals; the metal housing wraps the insulative housing, and the upper metal tab and the lower metal tab are positioned between the metal housing and the insulative housing.

2. The electric connector according to claim 1, wherein:

the electric connector further comprises a printed circuit board received in the clamping space, the printed circuit board being provided with a first soldering region; and the first soldering portion and the second soldering portion are soldered in the first soldering region of the printed circuit board.

3. The electric connector according to claim 2, wherein:

the first barrier is provided with a first bump, the second barrier is provided with a second bump, and the first soldering region is received at the rear end of the insulative housing and abuts against the first bump and the second bump.

4. The electric connector according to claim 3, wherein:

a first receiving space is formed between the first bump and the second bump; and the electric connector further comprises a grounding tab;

wherein the grounding tab is positioned between the first conductive terminals and the second conductive terminals, a rear end portion of the grounding tab is received in the receiving space, the grounding tab is provided with a grounding pin, and the printed circuit board is provided with a second soldering region, the grounding pin being soldered in the second soldering region.

5. The electric connector according to claim 1, wherein:

the first connection portion is upwardly provided with a first detention point and a second detention point, wherein the first detention point is received in each of the first terminal grooves, and the second detention point abuts against an end face of the base; and the second connection portion is downwardly provided with a third detention point and a fourth detention point, wherein the third detention point is received in each of the second terminal grooves, and the fourth detention point abuts against the end face of the base.

6. A cable connector assembly, comprising:

an insulative housing, comprising a base, a front end portion and a rear end portion that extend from two ends of the base, the rear end portion being via extension from the base towards an upper rear part and a lower rear part, the front end of the insulative housing being provided with first terminal grooves and second terminal grooves, a top portion at the rear end of the insulative housing being provided with a first barrier, a bottom portion at the rear end of the insulative housing being provided with a second barrier, first receiving grooves being formed between two neighboring first barriers, second receiving grooves being formed between two neighboring second barriers, a clamping space being formed between the first barrier and the second barrier;

first conductive terminals, each of the first conductive terminals comprising a first contact portion, a first connection portion having one end connected to the first contact portion, and a first extension portion extending from the other end of the first connection portion towards a direction distal from the second conductive terminals, the first contact portion and the first connection portion being both positioned in each of the first terminal grooves, the first extension portion being inserted into each of the first receiving grooves;

second conductive terminals, each of the second conductive terminals comprising a second contact portion, a second connection portion having one end connected to the second contact portion, and a second extension portion extending from the other end of the second connection portion towards a direction distal from the first conductive terminals, the second contact portion and the second connection portion being both positioned in each of the second terminal grooves, the second extension portion being inserted into each of the second receiving grooves;

an upper metal tab positioned on an upper surface of the insulative housing; and a lower metal tab and a metal housing positioned on a lower surface of the insulative housing;

wherein a first soldering portion is formed by extension at the first extension portion along a direction facing towards each of the second conductive terminals, and a second soldering portion is formed by extension at the second extension portion along a direction facing towards each of the first conductive terminals; and a printed circuit board received in the clamping space, the first soldering portion and the second soldering portion being soldered on the printed circuit board; the metal housing wraps the insulative housing, and the upper metal tab and the lower metal tab are positioned between the metal housing and the insulative housing.

7. The cable connector assembly according to claim 6, further comprising:

an upper housing; and a lower housing, on which the upper housing is jointed, a second receiving space for receiving the printed circuit board being formed between the upper housing and the lower housing, each side wall of the lower housing being partially outwardly bent to form a receiving groove on the side wall of the lower housing, each side of the printed circuit board being received in the receiving groove, the insulative housing being secured at a front end of the upper housing and the lower housing.

8. The cable connector assembly according to claim 7, wherein:

each side wall of the upper housing is inwardly bent to form a holding portion, the holding portion abutting against an upper surface of the printed circuit board.

9. The cable connector assembly according to claim 7, wherein:

each side wall of the upper housing is provided with an opening, the opening mating with the partially outwardly bending portion of the side wall of the lower housing, such that a lower end of the opening on the side wall of the upper housing abuts against an upper end of the bending portion.

10. The cable connector assembly according to claim 6, wherein:

the cable connector assembly further comprises a grounding tab, the grounding tab being positioned between the first conductive terminals and the second conductive terminals, the grounding tab being provided with a grounding pin, the grounding pin being soldered on the printed circuit board.

11. The cable connector assembly according to claim 6, wherein:

the first connection portion is upwardly provided with a first detention point and a second detention point, wherein the first detention point is received in each of the first terminal grooves, and the second detention point abuts against an end face of the base; and the second connection portion is downwardly provided with a third detention point and a fourth detention point, wherein the third detention point is received in each of the second terminal grooves, and the fourth detention point abuts against the end face of the base.

* * * * *